US010126074B2

(12) United States Patent
Bravo Rodriguez et al.

(10) Patent No.: US 10,126,074 B2
(45) Date of Patent: Nov. 13, 2018

(54) HEAT EXCHANGER HAVING A BAFFLE

(71) Applicant: Valeo Termico, S.A., Zaragoza (ES)

(72) Inventors: Yolanda Bravo Rodriguez, Zaragoza (ES); Juan Carlos De Francisco Moreno, Zaragoza (ES); Fernando Puertolas Sanchez, Zaragoza (ES); Francisco Lopez Lazaro, Zaragoza (ES)

(73) Assignee: Valeo Termico, S.A., Zaragoza (ES)

( * ) Notice: Subject to any disclaimer, the term of this patent is extended or adjusted under 35 U.S.C. 154(b) by 0 days.

(21) Appl. No.: 15/327,527

(22) PCT Filed: Jul. 24, 2015

(86) PCT No.: PCT/EP2015/067081
§ 371 (c)(1),
(2) Date: Jan. 19, 2017

(87) PCT Pub. No.: WO2016/012621
PCT Pub. Date: Jan. 28, 2016

(65) Prior Publication Data

US 2017/0153071 A1 Jun. 1, 2017

(30) Foreign Application Priority Data

Jul. 25, 2014 (ES) ..... 201431124

(51) Int. Cl.
*F28D 7/00* (2006.01)
*F28F 9/22* (2006.01)
(Continued)

(52) U.S. Cl.
CPC ..... *F28F 9/22* (2013.01); *F28D 7/1684* (2013.01); *F28D 21/0003* (2013.01);
(Continued)

(58) Field of Classification Search
CPC ..... F28D 7/1684; F28D 21/0003; F28D 2021/008; F28D 2021/0082; F28F 9/22; F02M 26/29; F02M 26/32; F02B 29/0462
(Continued)

(56) References Cited

U.S. PATENT DOCUMENTS

2009/0277606 A1 11/2009 Reiss, III et al.
2014/0308506 A1* 10/2014 Guillemette ..... B29C 47/065 428/221

FOREIGN PATENT DOCUMENTS

EP 2 725 219 A1 4/2014
EP 2 728 155 A1 5/2014
JP 2008/196319 A 8/2008

OTHER PUBLICATIONS

International Search Report issued in corresponding application No. PCT/EP2015/067081 dated Sep. 30, 2015 (4 pages).
(Continued)

*Primary Examiner* — Davis Hwu
(74) *Attorney, Agent, or Firm* — Osha Liang LLP

(57) ABSTRACT

The invention is related to a heat exchanger (1), which comprises:

at least one column of parallel tubes (2) which are arranged in a stack and which define a longitudinal direction;

a housing (3) inside which the tubes (2) are housed, the tubes (2) being separated from one another, so as to configure a channel for the passage of cooling fluid consisting of:

passage sections (4) between tubes (2) that are contiguous in the direction of the stack;

passage sections (5) between tubes and housing (3); and baffles (6, 7) that deflect the cooling fluid.

(Continued)

According to the invention, the baffles are at least two lamellar bodies (6, 7) of a single piece arranged in a plane perpendicular to the longitudinal direction.

8 Claims, 2 Drawing Sheets

(51) Int. Cl.

| | |
|---|---|
| ***F28D 7/16*** | (2006.01) |
| ***F28D 21/00*** | (2006.01) |
| *F02B 29/04* | (2006.01) |
| *F02M 26/29* | (2016.01) |
| *F02M 26/32* | (2016.01) |

(52) U.S. Cl.
CPC ..... *F02B 29/0462* (2013.01); *F02M 26/29* (2016.02); *F02M 26/32* (2016.02); *F28D 2021/008* (2013.01); *F28D 2021/0082* (2013.01)

(58) Field of Classification Search
USPC ..... 165/159
See application file for complete search history.

(56) References Cited

OTHER PUBLICATIONS

Written Opinion of the International Searching Authority issued in corresponding application No. PCT/EP2015/067081 dated Sep. 30, 2015 (5 pages).

* cited by examiner

HEAT EXCHANGER HAVING A BAFFLE

The present invention relates to a heat exchanger provided with one or more baffles that guide the cooling flow in order to obtain optimum exchange of heat between cooling fluid and cooled fluid.

CONTEXT OF THE INVENTION

Already known in the automotive sector are heat exchangers which comprise:

- at least one column of parallel tubes of rectangular cross section which are arranged in a stack and which define a longitudinal direction;
- a housing inside which the tubes are housed, the tubes being equipped on their upper and lower sides with protrusions intended to keep the tubes assembled with one another and with the housing with a separation so as to configure a channel for the passage of cooling fluid consisting of:
  - passage sections between tubes that are contiguous in the direction of the stack;
  - passage sections between tubes and housing.

Consequently, the cooling fluid is forced to pass via said passage sections, in contact with the external surface of the tubes, so that an exchange of heat takes place between the fluid that is to be cooled which passes along the inside of the tubes and the cooling fluid.

In general, for reasons of space, there are very few options as to how to configure the inlets and outlets either of the cooled fluid, which enters via one end of the tubes and leaves via the other end, namely which travels through the heat exchanger in the longitudinal direction, or of the cooling fluid, which enters at the upper part via the front of the exchanger to leave via the rear part, preferably on the side.

This configuration, which can be varied in numerous ways, provides only limited control over the configuration of the thermal gradients between the two fluids because it is possible that exchanger zones, particularly the corners remote from the inlets and outlets of cooling fluid and also referred to as stagnation zones will remain, in which the flow of cooling fluid is lower and as a result in which the cooling efficiency is compromised.

In order to reduce stagnation zones, the use of baffles that deflect the cooling fluid, which constitute obstacles that are placed in the passage sections with a view to configuring the flow more effectively is known.

Nevertheless, there does not yet exist any multifunction solution that is compatible with a method of assembling tubes and baffles.

DESCRIPTION OF THE INVENTION

In order to fill this gap, there is proposed a heat exchanger, which comprises:

- at least one column of parallel tubes which are arranged in a stack and which define a longitudinal direction;
- a housing inside which the tubes are housed, the tubes being separated from one another, so as to configure a channel for the passage of cooling fluid consisting of:
  - passage sections between tubes that are contiguous in the direction of the stack;
  - passage sections between tubes and housing; and
- baffles that deflect the cooling fluid;

and which is characterized in that the baffles are at least two lamellar bodies of a single piece arranged in a plane perpendicular to the longitudinal direction and cut out in such a way that each has:

- a first section able to partially obstruct a passage section between tubes and housing,
- extensions which extend from said first section at right angles thereto and which are able to obstruct passage sections between tubes that are contiguous in the direction of the stack, the length of the extensions of each of the lamellar bodies being such that the extensions of one of the lamellar bodies overlap with the extensions of the other lamellar body so that each lamellar body can be introduced laterally with respect to the tubes and constitute a baffle that deflects the cooling fluid.

For preference, the tubes are equipped on their upper and lower sides with protrusions intended to keep the tubes assembled with each other and with the housing.

For preference, the tubes are of rectangular cross section.

Advantageously, the exchanger comprises two contiguous columns of parallel tubes of rectangular cross section arranged in the stack.

For preference, each lamellar body comprises a terminal section parallel to the extensions and which obstructs the passage section for cooling fluid between the housing and the lower or upper tube of the stack.

Advantageously, the terminal section of the lamellar bodies comprises cutouts able to collaborate with the protrusions of the housing.

More advantageously, the exchanger comprises an upper frontal inlet for cooling fluid and a lateral posterior outlet for cooling fluid, two lamellar bodies arranged to obstruct the passage section for cooling fluid via the upper part immediately downstream of the upper frontal inlet for cooling fluid and two lamellar bodies arranged to obstruct the passage section for cooling fluid via the lower part immediately upstream of the lateral posterior outlet for cooling fluid.

Finally, each of the first sections comprises flanges which extend at right angles from their edge for contact with the tubes so that they constitute plates for fixing to the tubes.

BRIEF DESCRIPTION OF THE FIGURES

For a better understanding of what has just been explained, drawings are attached which schematically and solely by way of nonlimiting example depict one practical way of embodying the exchanger according to the invention.

DESCRIPTION OF ONE PREFERRED EMBODIMENT

Figure 1:
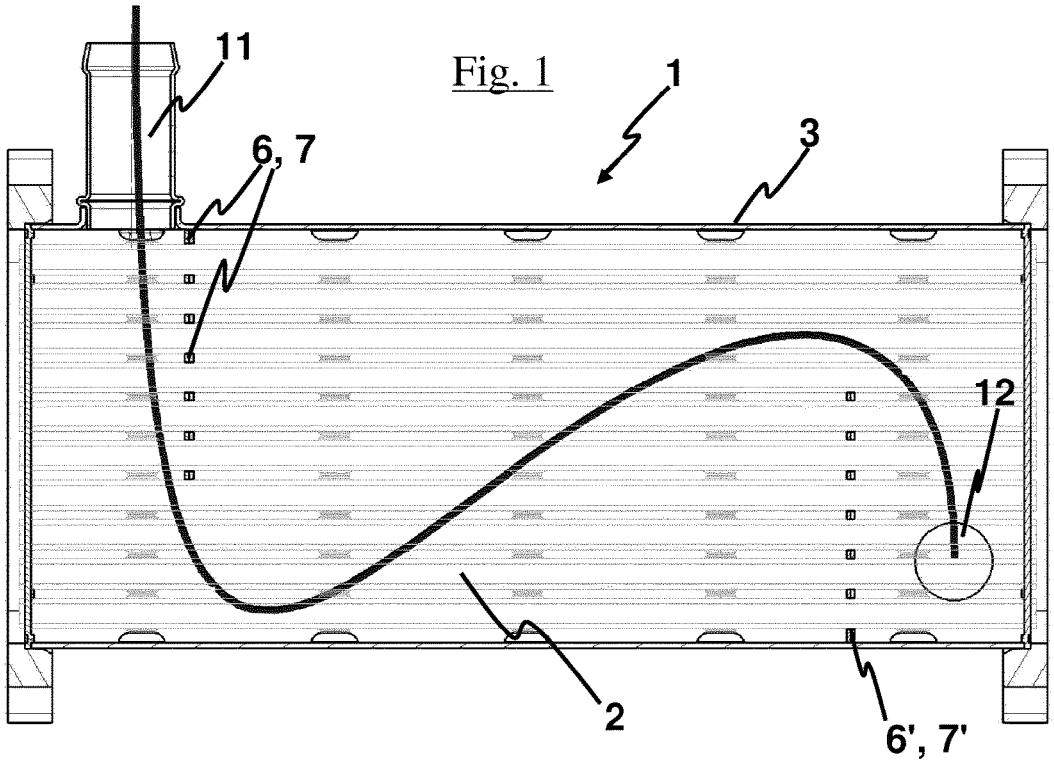
FIG. 1 is a cross section in elevation of the exchanger according to the invention.
Figure 2:
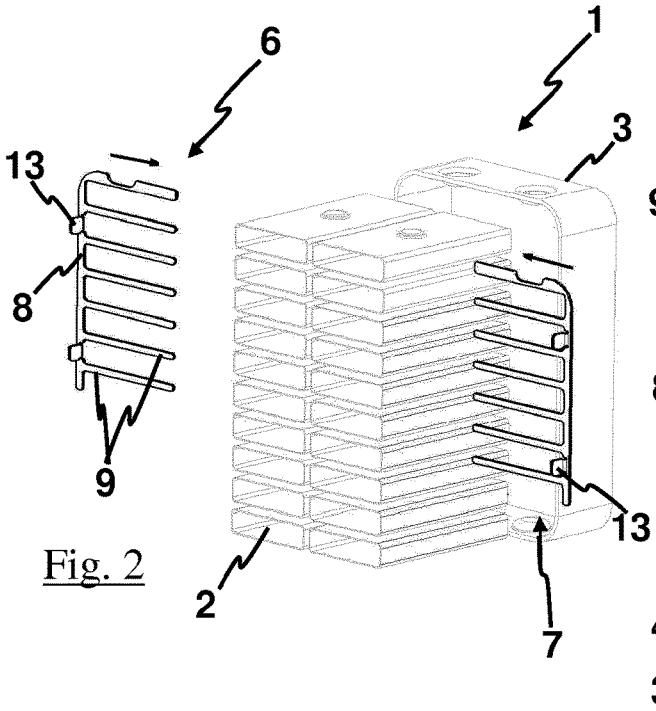
FIG. 2 is an exploded perspective view of the exchanger according to the invention.

As may be seen from the figures, the invention relates to a heat exchanger 1, which comprises:

- at least one column of parallel tubes 2, very preferably of rectangular cross section, which are arranged in a stack and which define a longitudinal direction;
- a housing 3 inside which the tubes 2 are housed, the tubes 2 being separated from one another, so as to configure a channel for the passage of cooling fluid consisting of:

passage sections 4 between tubes 2 that are contiguous in the direction of the stack;

passage sections 5 between tubes and housing 3; and baffles 6, 7 that deflect the cooling fluid;

and which is characterized in that the baffles are at least two lamellar bodies 6, 7 of a single piece arranged in a plane perpendicular to the longitudinal direction and cut out in such a way that each has:

a first section 8 able to partially obstruct a passage section 5 between tubes and housing 3, extensions 9 which extend from said first section 8 at right angles thereto and which are able to obstruct passage sections 4 between tubes 2 that are contiguous in the direction of the stack, the length of the extensions 9 of each of the lamellar bodies 6, 7 being such that the extensions 9 of one of the lamellar bodies 6 overlap with the extensions 9 of the other lamellar body 7 so that each lamellar body 6, 7 can be introduced laterally with respect to the tubes and constitute a baffle that deflects the cooling fluid.

Consequently, in other words, the baffles are made up of two components which are comb-shaped and which are assembled by the sides by introducing the teeth of the comb between the tubes 2. The ends of these "combs" become superposed to constitute the equivalent of a one-piece component.

The fact that assembly is performed from the side at right angles by contrast with an assembly in parallel, namely by means of introduction in the longitudinal direction, avoids the need to provide cutouts to correspond with the connecting protrusions on the components that make up the baffle. Such cutouts would be numerous and that would therefore involve undesirable choices of passage for the cooling fluid.

As can be seen in the figures, the tubes 2 are equipped on their upper and lower sides with protrusions P intended to keep the tubes 2 assembled with each other and with the housing 3.

As can be seen in the figures, according to a preferred embodiment, the exchanger comprises two contiguous columns of parallel tubes 2 of rectangular cross section arranged in the stack. In that case obviously the passage section between contiguous tubes in the horizontal direction is not plugged by the components or "combs", but this is a cross section of little significance.

Each lamellar body 6, 7 comprises a terminal section 10 parallel to the extensions 9 and which obstructs the passage section for cooling fluid between the housing 3 and the lower or upper tube of the stack. This terminal section 10 can be assembled by brazing to the upper (lower) surface of the upper (lower) tube in order to contribute to the fixing of the baffles to the tubes.

The exchanger comprises an upper frontal inlet 11 for cooling fluid and a lateral posterior outlet 12 for cooling fluid, two lamellar bodies 6, 7 arranged to obstruct the passage section for cooling fluid via the upper part immediately downstream of the upper frontal inlet 11 for cooling fluid and two lamellar bodies 6', 7' arranged to obstruct the passage section for cooling fluid via the lower part immediately upstream of the lateral posterior outlet 12 for cooling fluid.

The overall modification to the flow of cooling fluid that is obtained with the two pairs of baffle components can be discerned in FIG. 1. Obviously, any combination of baffle components can be used in order to achieve the desired flow pattern.

Each of the first sections 8 comprises flanges 13 which extend at right angles from their edge for contact with the tubes so that they constitute plates for laterally fixing to the tubes 2.

Finally, the components that constitute the baffles comprise cutouts 14 intended to allow the internal assembly protrusions for the housing to pass, because the housing is mounted by slipping it over everything once the baffles have been placed on the tubes and fixed to the latter.

Figure 3:
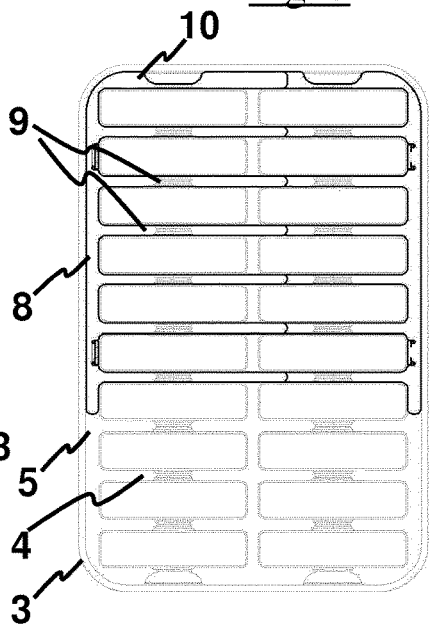
FIG. 3 is a face-on view.
Figure 4:
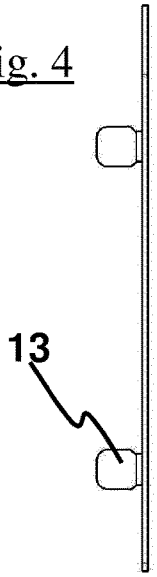
FIGS. 4 and 5 are side and front elevations of one of the individual components that make up the baffle means.
Figure 5:
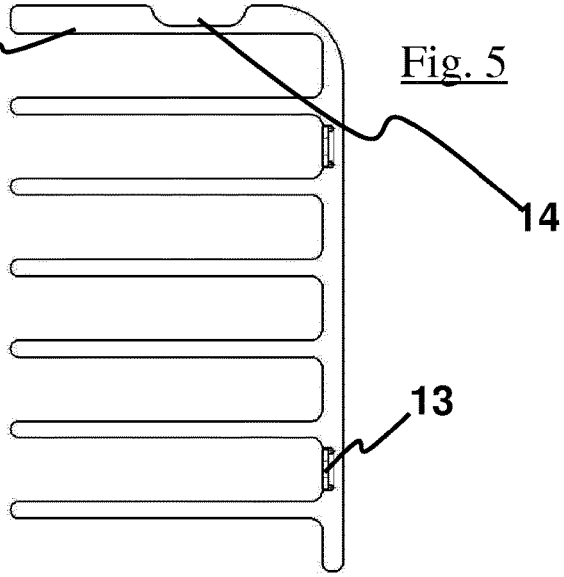
Figure 6:
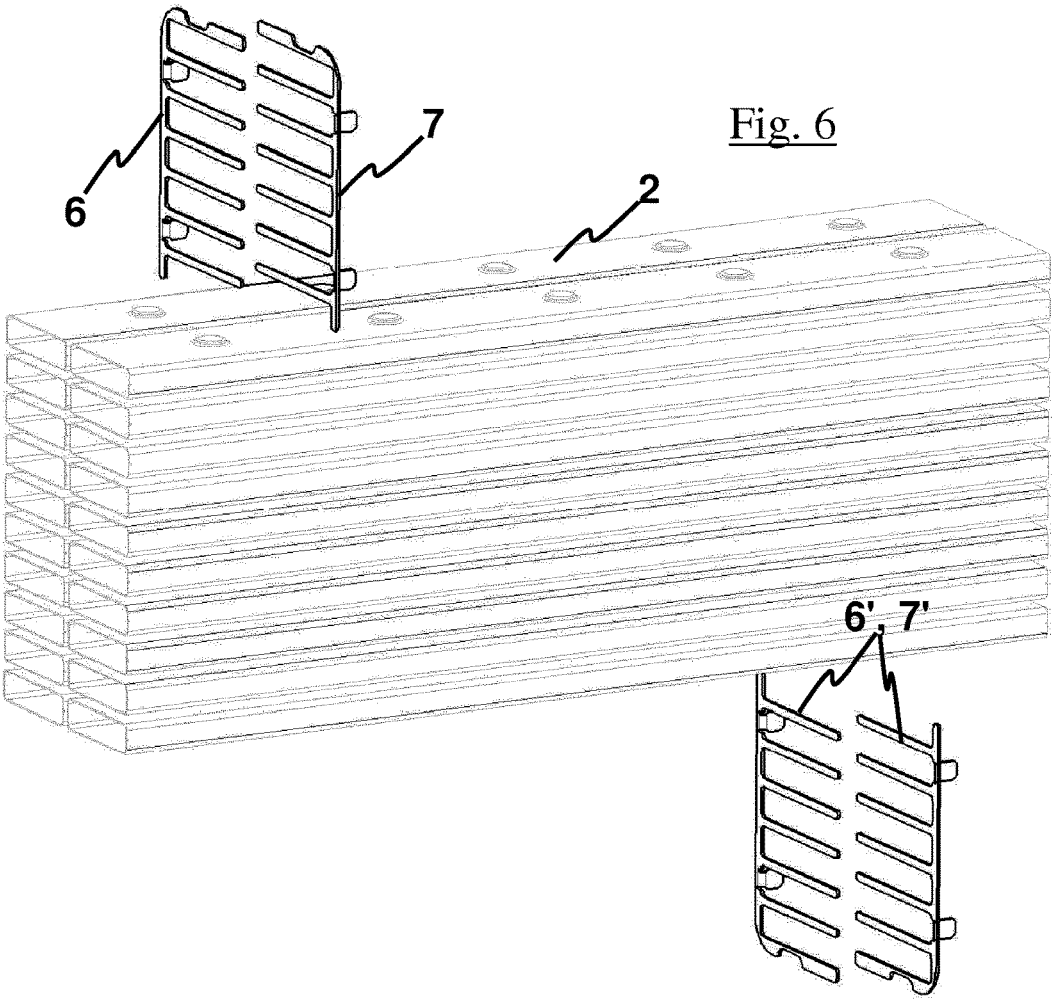
FIG. 6 is an exploded perspective view of a set of tubes and of two pairs of baffle components.

As can be seen for example in FIGS. 1 and 3, the components cover between half and two-thirds of the passage section, even though in each case it is possible to determine the optimum number of pairs of components in order to obtain the desired flow of cooling fluid.

Although reference has been made to one concrete embodiment of the invention, it is obvious to a person skilled in the art that the exchanger described here can be varied and modified in numerous ways and that all the details mentioned can be replaced by technically equivalent others, without thereby departing from the umbrella of protection defined by the attached claims.

The invention claimed is:

1. A heat exchanger comprising:

at least one column of parallel tubes which are arranged in a stack and which define a longitudinal direction;

a housing inside which the tubes are housed, the tubes being separated from one another, so as to configure a channel for the passage of cooling fluid consisting of:

passage sections between tubes that are contiguous in the direction of the stack;

passage sections between tubes and housing; and baffles that deflect the cooling fluid;

wherein the baffles are at least two lamellar bodies of a single piece arranged in a plane perpendicular to the longitudinal direction and cut out in such a way that each has:

a first section able to partially obstruct a passage section between tubes and housing, and extensions which extend from said first section at right angles thereto and which are able to obstruct passage sections between tubes that are contiguous in the direction of the stack, the length of the extensions of each of the lamellar bodies being such that the extensions of one of the lamellar bodies overlap with the extensions of the other lamellar body so that each lamellar body is introduced laterally with respect to the tubes and constitute a baffle that deflects the cooling fluid.

2. The exchanger as claimed in claim 1, in which the tubes are equipped on their upper and lower sides with protrusions intended to keep the tubes assembled with each other and with the housing.

3. The exchanger as claimed in claim 1, in which the tubes are of rectangular cross section.

4. The exchanger as claimed in claim 1, which comprises two contiguous columns of parallel tubes of rectangular cross section arranged in the stack.

5. The exchanger as claimed in claim 1, in which each lamellar body comprises a terminal section parallel to the extensions and which obstructs the passage section for cooling fluid between the housing and the lower or upper tube of the stack.

6. The exchanger as claimed in claim 2, in which the terminal section of the lamellar bodies comprises cutouts able to collaborate with the protrusions of the housing.

7. The exchanger as claimed in claim 1, which comprises an upper frontal inlet for cooling fluid and a lateral posterior outlet for cooling fluid, two lamellar bodies arranged to obstruct the passage section for cooling fluid via the upper part immediately downstream of the upper frontal inlet for cooling fluid and two lamellar bodies arranged to obstruct the passage section for cooling fluid via the lower part immediately upstream of the lateral posterior outlet for cooling fluid.

8. The exchanger as claimed in claim 1, in which each of the first sections comprises flanges which extend at right angles from their edge for contact with the tubes so that they constitute plates for fixing to the tubes.

* * * * *